US010036199B2

(12) United States Patent
Chang et al.

(10) Patent No.: US 10,036,199 B2
(45) Date of Patent: Jul. 31, 2018

(54) WINDOW BLIND

(71) Applicant: NIEN MADE ENTERPRISE CO., LTD., Taichung (TW)

(72) Inventors: Chih-Yao Chang, Taichung (TW); Lin Chen, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 15/387,215

(22) Filed: Dec. 21, 2016

(65) Prior Publication Data

US 2018/0171704 A1 Jun. 21, 2018

(51) Int. Cl.
*E06B 9/303* (2006.01)
*E06B 9/322* (2006.01)

(52) U.S. Cl.
CPC ..... *E06B 9/303* (2013.01); *E06B 9/322* (2013.01)

(58) Field of Classification Search
CPC ..... E06B 9/303; E06B 9/307; E06B 9/322
USPC ..... 160/176.1 R
See application file for complete search history.

(56) References Cited

U.S. PATENT DOCUMENTS

| | | | | | |
|---|---|---|---|---|---|
| 2,200,349 | A * | 5/1940 | Walker | E06B 9/305 | 160/168.1 R |
| 5,692,552 | A * | 12/1997 | Judkins | E06B 9/262 | 160/168.1 R |
| 5,769,143 | A * | 6/1998 | Morgan | E06B 9/303 | 160/168.1 R |
| 7,178,576 | B2 * | 2/2007 | Nien | E06B 9/303 | 160/168.1 R |
| 2004/0188038 | A1 * | 9/2004 | Nien | E06B 9/303 | 160/168.1 R |

* cited by examiner

*Primary Examiner* — Blair M Johnson
(74) *Attorney, Agent, or Firm* — Tracy Helms; Apex Juris, Pllc.

(57) ABSTRACT

A window blind includes a headrail, a bottom rail, and a plurality of slats. The slats are horizontally suspended between the headrail and the bottom rail through ladder tapes. Each ladder tape has two warps, wherein an end of the warps is connected to a ladder drum, and another end thereof passes through the bottom rail to be connected thereto. When the ladder drum is rotated, the ladder tapes could be pulled smoothly, and the slats supported by the ladder tapes could be tightly closed. Whereby, the window blind could provide a good shielding effect.

8 Claims, 9 Drawing Sheets

WINDOW BLIND

BACKGROUND OF THE INVENTION

1. Technical Field

The present invention relates generally to a window blind, and more particularly to a specific type of window blind which could tightly close the slats thereof when lowered.

2. Description of Related Art

A conventional window blind is illustrated in FIG. 1 and FIG. 2, including a headrail 1, a bottom rail 2, and a plurality of slats 3, wherein the slats 3 are suspended in parallel between the headrail 1 and the bottom rail 2 through ladder tapes 4. Said ladder tapes 4 have warps respectively arranged in front and back of the slats 3, and an end of each warp is connected to the bottom rail 2, while another end thereof is connected to a ladder drum 5 provided rotatably in the headrail 1. By rotating the ladder drum 5, a tilt angle of the slats 3 can be adjusted, for one of the warps goes up and the other goes down when the ladder drum 5 is rotated. In this way, the window blind allows different amount of light to travel through. The controlling of the rotation of the ladder drum 5 is a known technique. Thus we are not going to describe it in details herein.

As shown in FIG. 2, said conventional window blind further includes a plurality of lifting cords 6, which are adapted to raise and lower the bottom rail 2, wherein each of the lifting cords 6 is respectively arranged near one of the warps 4*a* of one of the ladder tapes 4. An end of the lifting cords 6 is connected to the bottom rail 2, and another end thereof is connected to a power mechanism (not shown) provided in the headrail 1. Said power mechanism could be a manually operated cord or bead chain system, or a spring case or an electrical control system which can be powered to rewind the slat assembly or the lifting cords. The power mechanism is a spring case as an example herein. With the balanced relationship between the rewinding force provided by the spring case and the weight of the bottom rail 2 and the slats 3, the bottom rail 2 could properly stay at any given position.

However, the mechanism for tilting the slats 3 and the mechanism for raising and lowering the bottom rail 2 are two irrelevant mechanisms. When the window blind is completely lowered and while the slats 3 are rotating toward a closed status, the warps 4*a* of each of the ladder tapes 4 are moved in opposite vertical directions, and are approaching each other. In the meantime, the bottom rail 2 does not rotate along with the slats 3 since the lifting cords 6 are not being moved. As a result, bottom ends of the warps 4*a* of each of the ladder tapes 4 are restricted by the unmoved bottom rail 2 from approaching each other. In such a condition, the lifting cords 6 on the side that the slats are rotated downward are tightened, which may affect the operation of the warps 4*a*, so that the slats 3 near the bottom rail 2 may have slits left between neighboring slats 3, and light may still leak in through those slits.

BRIEF SUMMARY OF THE INVENTION

In view of the above, the primary objective of the present invention is to provide a window blind, which makes slats thereof provide a good shielding effect when the window blind is lowered, whereby to solve the existing drawbacks of light leakage.

The present invention provides a window blind, wherein the window blind includes a headrail, a bottom rail, a plurality of slats, and a ladder tape. The ladder tape includes two warps provided from the headrail toward the bottom rail, and a plurality of horizontal strings connected to the warps, wherein each of the horizontal strings supports one of the slats, so that the slats are horizontally suspended between the headrail and the bottom rail. An end of each of the warps of the ladder tape is connected to the headrail, and another end thereof passes through the bottom rail. The warps are adapted to be operated to move relative to the bottom rail.

With the aforementioned design, when the ladder drums are rotated, the ladder tapes could be pulled smoothly to tightly close the slats resting on the ladder tapes, whereby to solve the existing drawbacks of light leakage.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
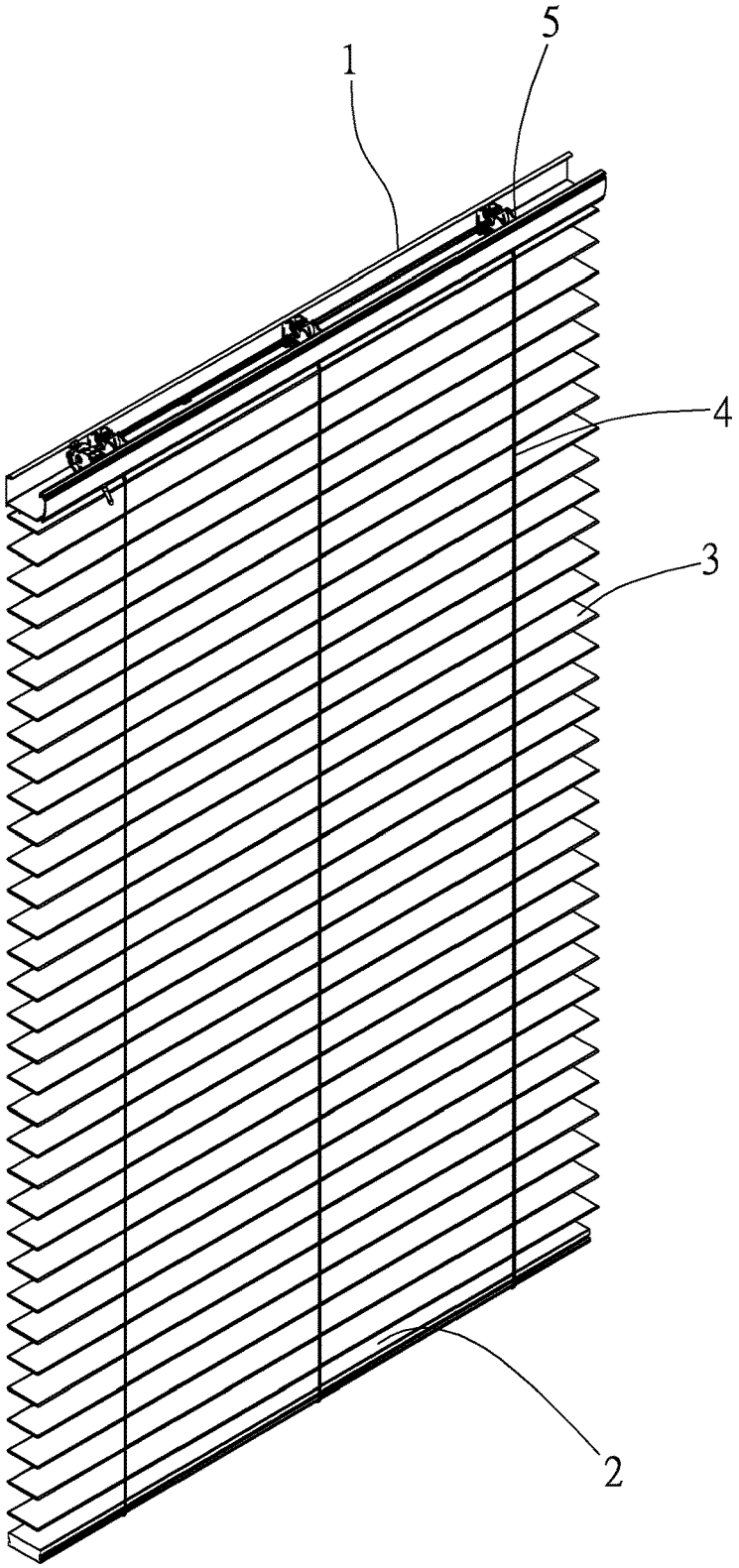
FIG. 1 (PRIOR ART)
FIG. 1 is a perspective view of a conventional window blind.
Figure 2:
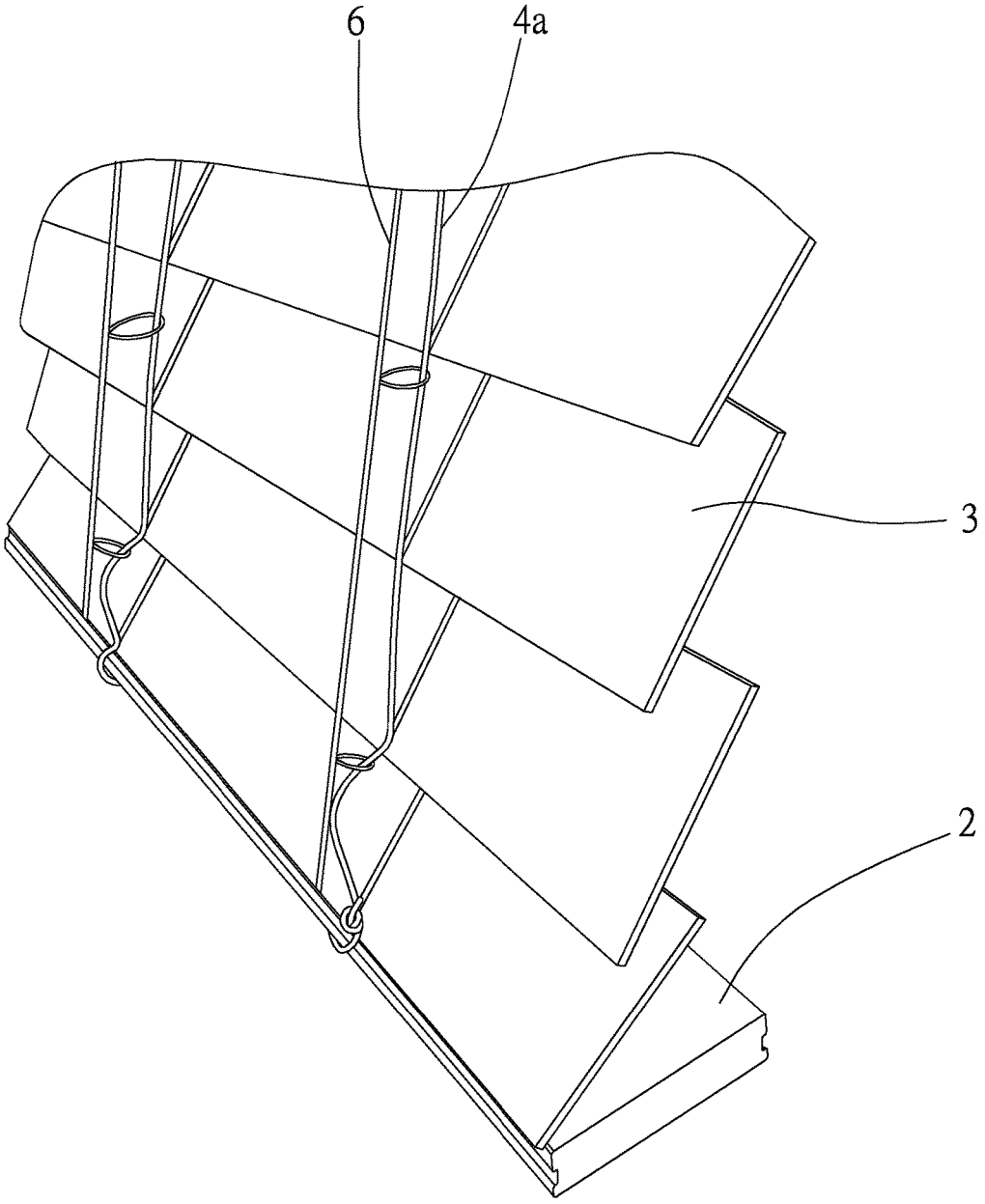
FIG. 2 (PRIOR ART)
FIG. 2 is a partial perspective view, showing the slats of the conventional window blind are tilted.
Figure 3:
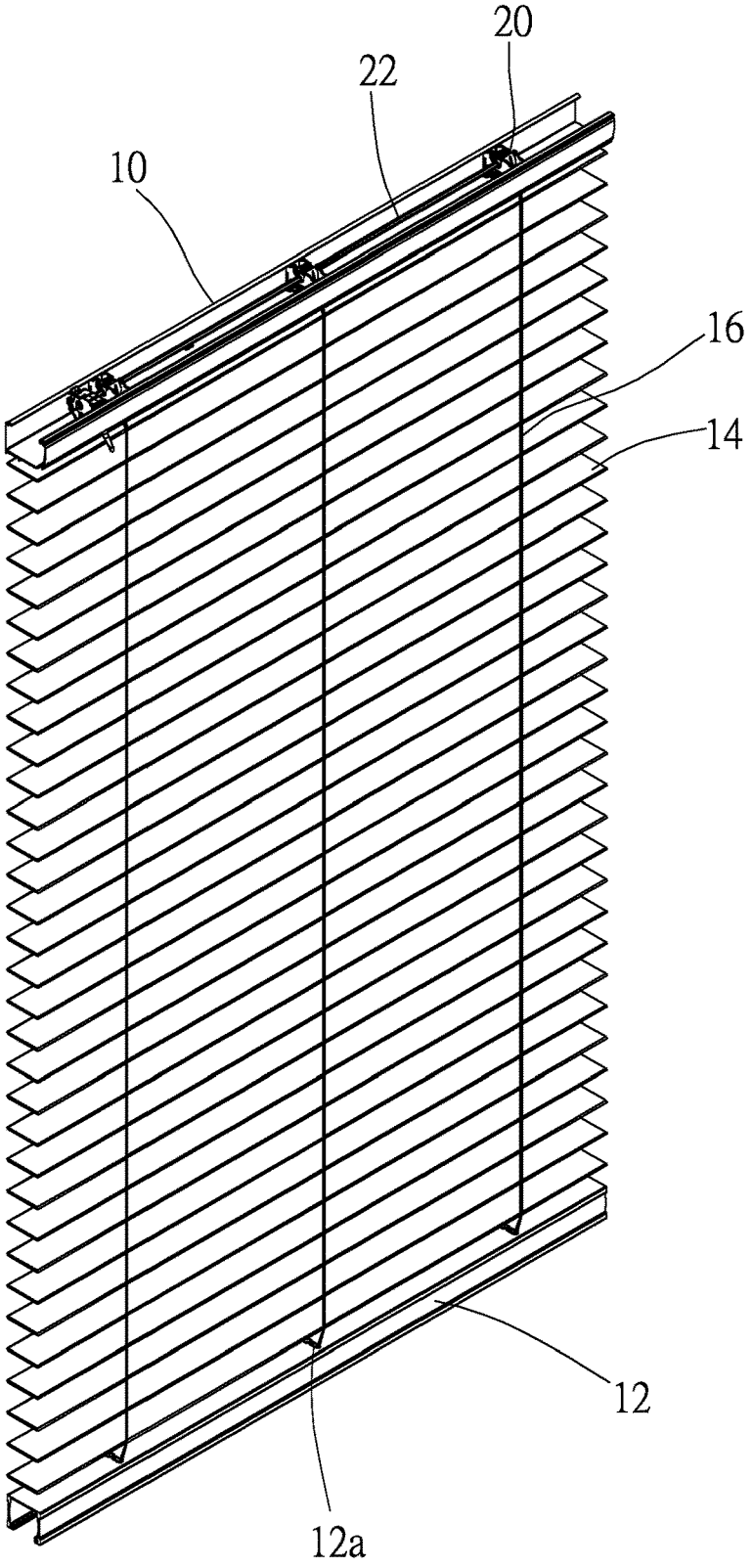
FIG. 3 is a perspective view of the window blind of a first embodiment of the present invention.
Figure 4:
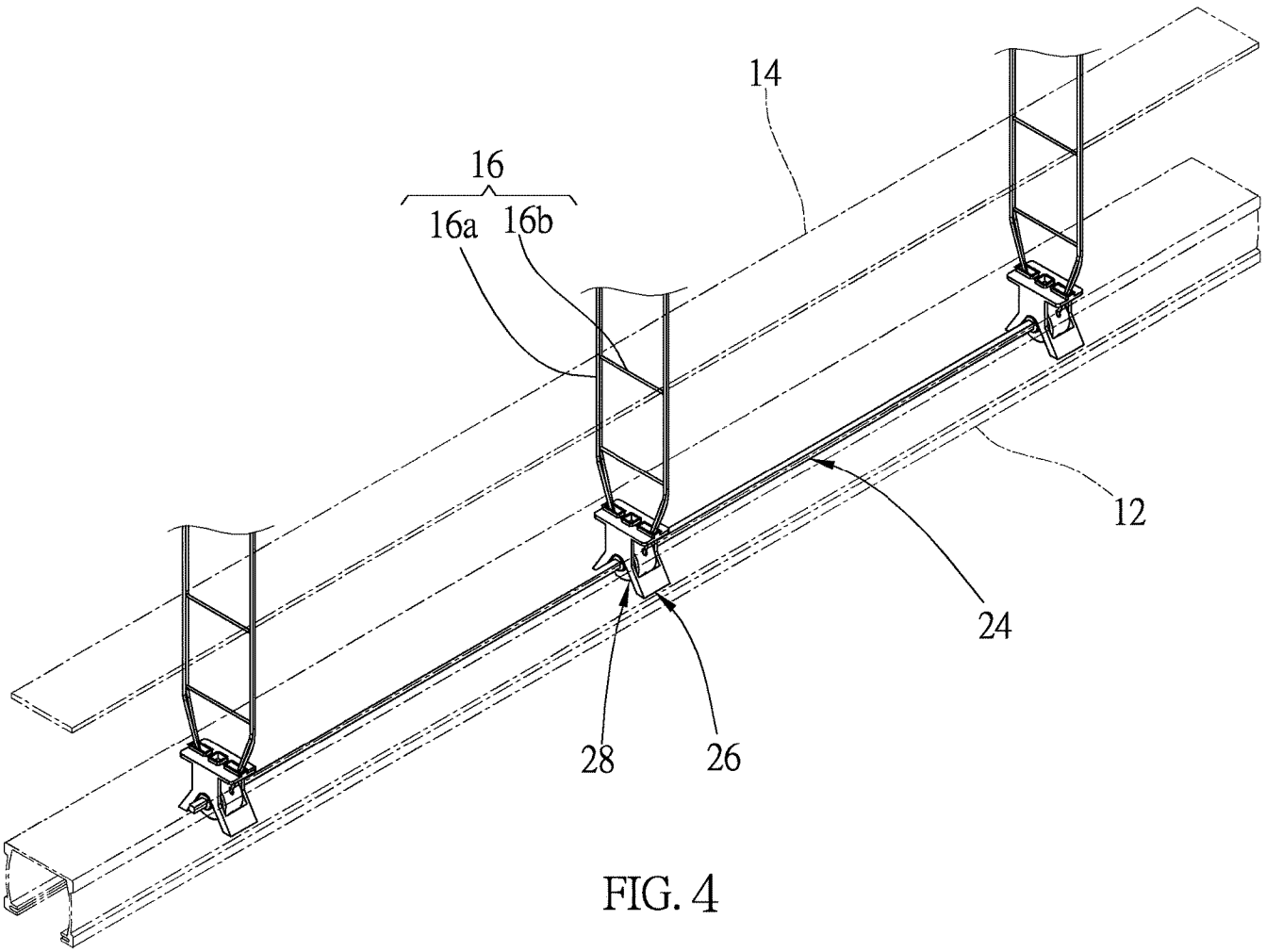
FIG. 4 is a schematic diagram, showing the structure of the window blind of the first embodiment near the bottom rail thereof.
Figure 5:
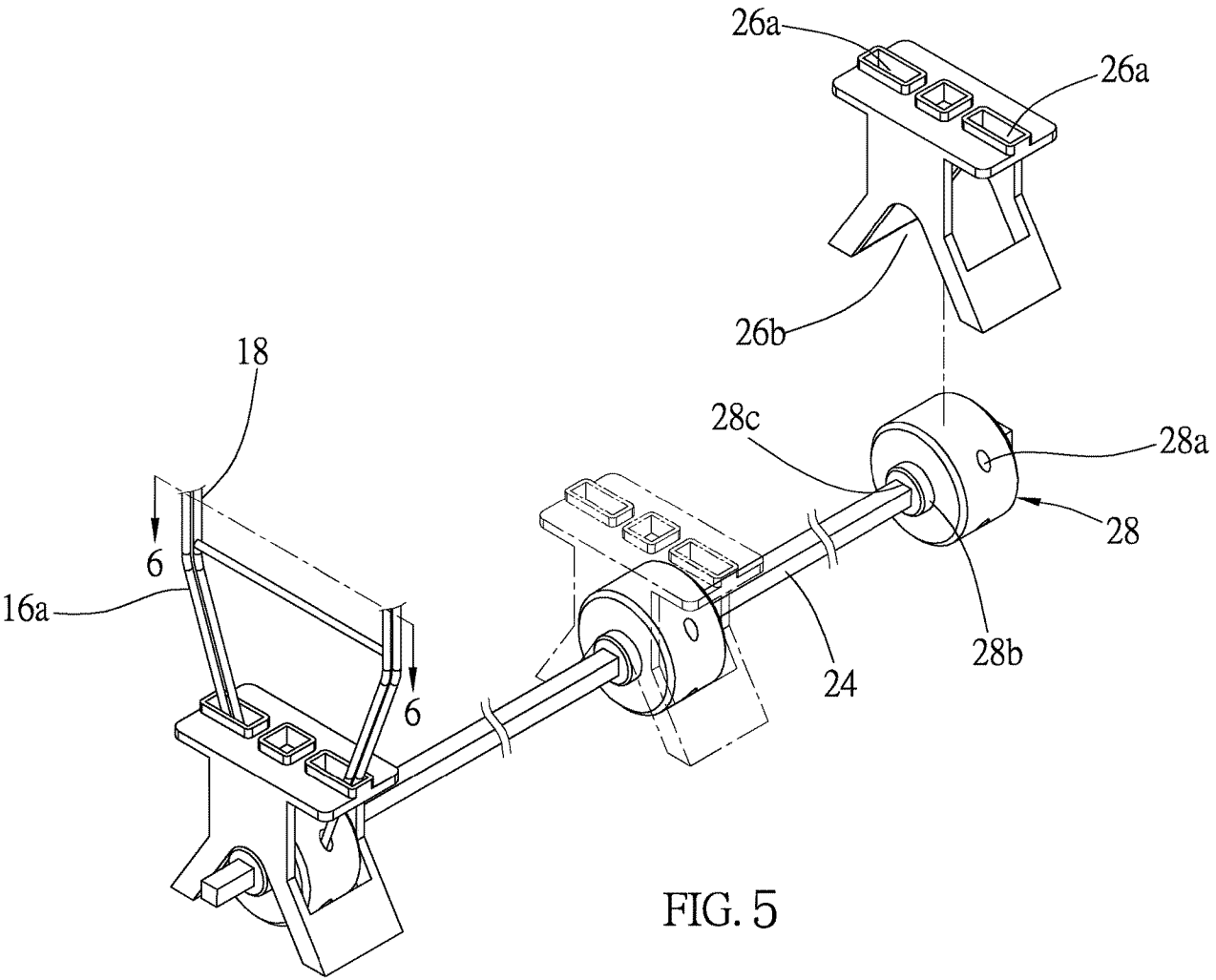
FIG. 5 is a perspective view, showing the positioning base and the direction-changing member of the window blind of the first embodiment.

A window blind 100 of a first embodiment of the present invention is illustrated in FIG. 3 to FIG. 5, including a headrail 10, a bottom rail 12, a plurality of slats 14, a plurality of ladder tapes 16, and a plurality of lifting cords 18. Each of the ladder tapes 16 includes two warps 16*a*, which are provided horizontally, and a plurality of horizontal strings 16*b* connected to the warps 16*a*. Each of the horizontal strings 16*b* supports one of the slats 14, whereby to horizontally suspend the slats between the headrail 10 and the bottom rail 12. Each of the lifting cords 18 is close to one of the warps 16*a*, and the lifting cords 18 could be reeled in or out, whereby to move the bottom rail 12 toward or away from the headrail 10. The mechanism for moving the bottom rail 12 is not the essence of the present invention. Thus we are not going to describe it in details herein.

The headrail 10 has ladder drums 20 provided therein, wherein the number of the ladder drums 20 corresponds to (i.e., equal to) the number of the ladder tapes 16. The ladder drums 20 are passed through by a shaft 22 to be rotated in the same direction synchronously. An end of the warps 16*a* of each of the ladder tapes 16 is connected to one of the ladder drums 20. When the ladder drums 20 are rotated, one of the warps 16*a* in each of the ladder tapes 16 would go up, and the other one of the warps 16*a* would go down. Whereby, a tilt angle of the slats 14 could be adjusted through the rotation of the ladder drums 20, and the window blind 100 could allow different amount of light to travel through in this way.

Figure 6:
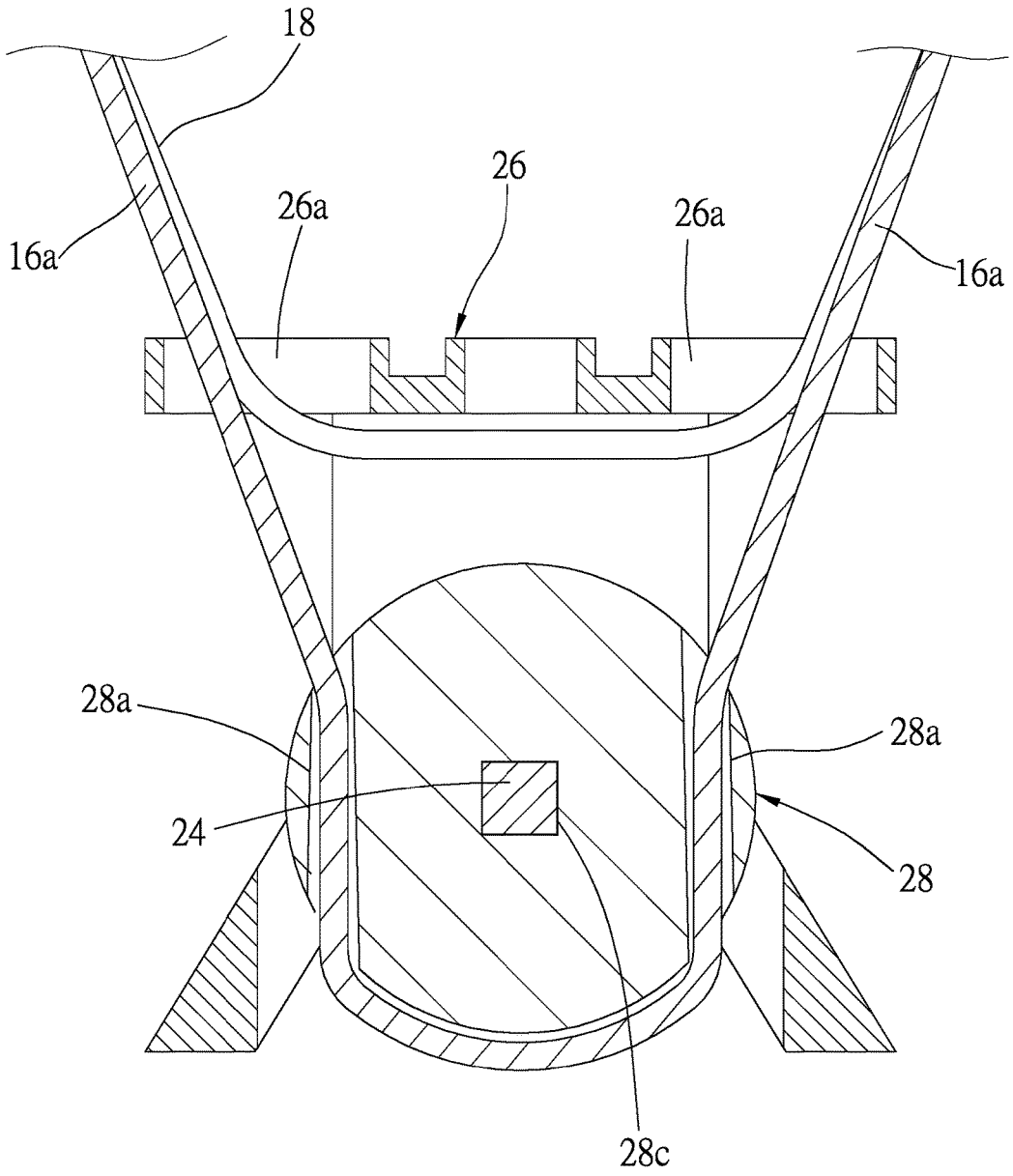
FIG. 6 is a sectional view along the 6-6 line in FIG. 5.

In the first embodiment, a cross section of the bottom rail 12 is substantially reverse U-shaped, and a plurality of bores 12*a* are provided on a top plate of the bottom rail 12. The window blind 100 further includes a transmission shaft 24 provided in the bottom rail 12, a plurality of positioning bases 26, and a plurality of direction-changing members 28, wherein the number of the positioning bases 26 and the number of the direction-changing members 28 correspond to (i.e., equal to) the number of the ladder tapes 16. As shown in FIG. 5 and FIG. 6, for each of the positioning bases 26, two perforations 26*a* are provided on a top thereof, and a recess 26*b* is provided on a bottom thereof, wherein an opening of the recess 26*b* faces downward. Each of the direction-changing members 28 is a cylinder, which has two passages 28*a* going through a circular surface thereof a circular shaft 28*b* is provided projecting from two lateral surfaces of each of the direction-changing members 28 along an axial direction thereof, wherein the circular shaft 28*b* of each of the direction-changing members 28 is adapted to abut against a bottom of the recess 26*b* of one of the positioning bases 26, whereby each of the direction-changing members 28 is rotatably located in the recesses 26*b* of one of the positioning bases 26. Each of the direction-changing members 28 has a polygonal shaft bore 28*c* provided in the axial direction thereof. The transmission shaft 24 is long, and a cross section thereof is polygonal, wherein the transmission shaft 24 passes through the shaft bores 28*c* of the direction-changing members 28, whereby the direction-changing members 28 could be rotated in the same direction synchronously. Though the opening of the recess 26*b* of each of the positioning bases 26 faces downward in the first embodiment, this is not a limitation of the present invention. In other embodiments, the opening could be a notch or a frame facing toward other directions, as long as the opening could restrict the direction-changing member 28 located therein from being moved in any directions except rotating around the axial direction of said direction-changing member 28. The shapes of the direction-changing members 28 and the shaft bores 28*c* thereof are not limitations of the present invention, either. In other embodiments, the direction-changing members 28 could be tubes or plates of different shapes, and the shapes of the shaft bores 28*c* could be any non-circular shapes corresponding to the cross section of the transmission shaft 24, so that the direction-changing members 28 could be driven by the transmission shaft 24.

Another end of the warps 16*a* of each of the ladder tapes 16 passes through the bottom rail 12 to be connected thereto. As shown in FIG. 6, in the first embodiment, the warps 16*a* of each of the ladder tapes 16 belong to one single cord arranged in a U shape. In more details, said cord passes through the passages 28*a* of the corresponding direction-changing member 28, the perforations 26*a* of the corresponding positioning base 26, and the corresponding bores 12*a* of the bottom rail 12, with two ends thereof connected to one of the ladder drums 20. The parts of said cord located in a short axial direction of the slats 14 are the warps 16*a*, and the part of said cord going along a bottom surface of the corresponding direction-changing member 28 forms a U shape. Whereby, the aforementioned technical feature that the warps 16*a* of each of the ladder tapes 16 pass through the bottom rail 12 to be connected thereto could be realized.

However, this is not the only way to achieve such technical feature. In other embodiments, the warps of one ladder tape could be two independent cords, each of which is connected to the corresponding ladder drum 20 with an end thereof, while another end thereof passes through one of the bores 12*a* of the bottom rail 12 and one of the passages 28*a* of the corresponding direction-changing member 28 to be knotted together. Alternatively, the another ends of said independent cords (i.e., the warps) could be connected to each other through a connector (not shown) after extending out of the passages 28*a* of the corresponding direction-changing member 28. These designs could also realize the aforementioned technical content that the warps 16*a* of each of the ladder tapes 16 pass through the bottom rail 12 to be connected thereto.

Figure 7:
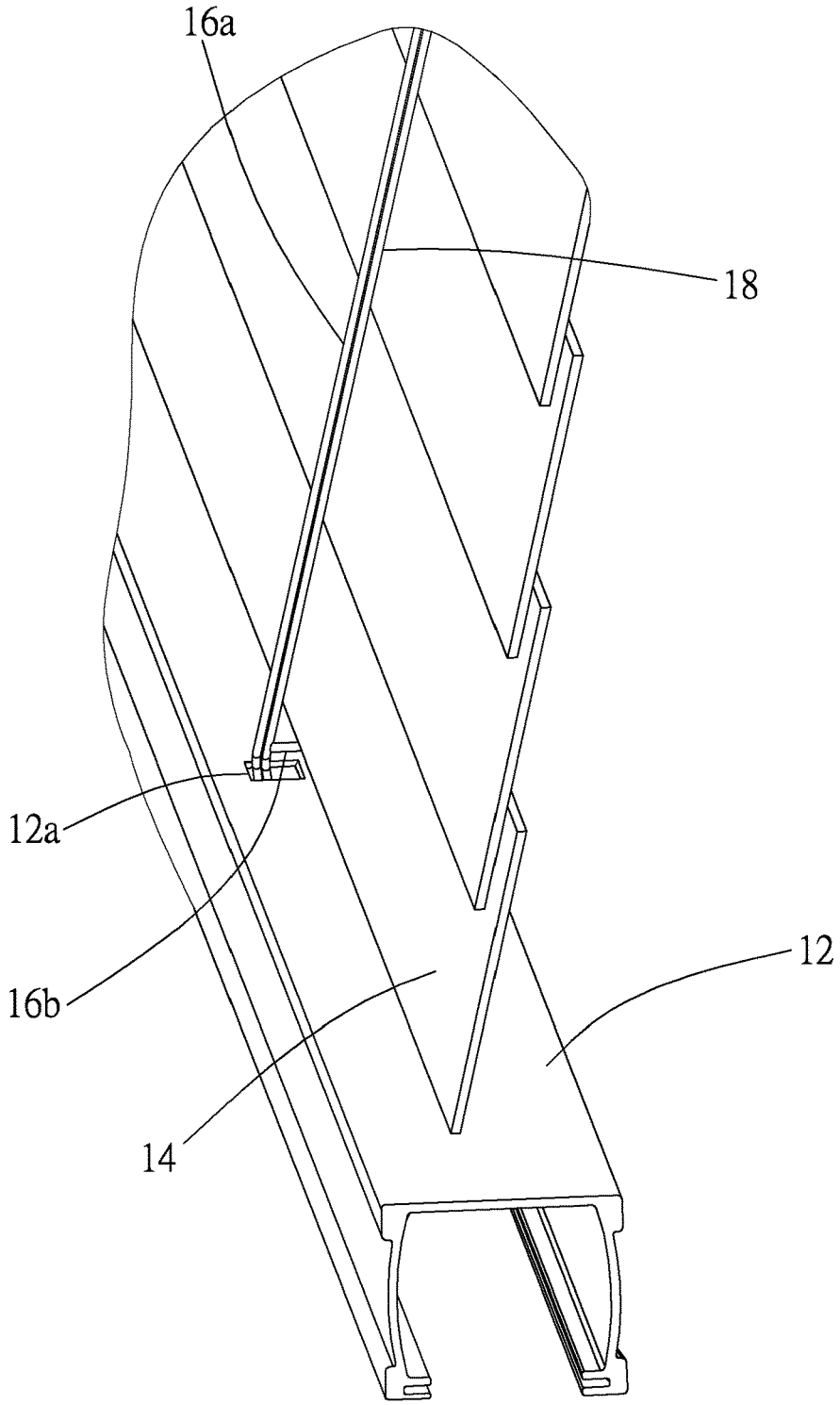
FIG. 7 is a partial perspective view, showing the slats of the window blind of the first embodiment are tilted.

Due to the weight of the bottom rail 12 and the slats 14 supported by the ladder tapes 16, and since the bottom surfaces of the direction-changing members 28 are bypassed by the ladder tapes 16, the circular shaft 28*b* of each of the direction-changing members 28 would tightly abut against the bottom of the corresponding recess 26*b*. When the window blind 100 is completely lowered and the slats 14 are in a horizontal status as shown in FIG. 3 to allow external light to pass through, the ladder tapes 16 would be tightened. When the ladder drums 20 are rotated to pull up one of the warps 16*a* of each of the ladder tapes 16 and to lower down the other one of the warps 16*a* thereof at the same time, the direction-changing members 28 would be also rotated along with the ladder drums 20 by the warps 16*a* passing through the passages 28*a*. In this way, the drawbacks that one of the warps is tightened while the other one of the warps is loosened could be eliminated, ensuring that each of the slats 14 could be tightly closed as shown in FIG. 7 after being tilted. It is worth noting that, even the slats 14 near the bottom rail 12 could be tightly closed as well, and therefore the window blind 100 could provide a good shielding effect.

Each of the ladder tapes 16 disclosed in the aforementioned embodiment has two warps 16*a* connected to one of the ladder drums 20 with one of the ends thereof, so that one of the warps 16*a* could go up while the other one goes down at the same time. However, in other embodiments, an end of one of the warps 16*a* could be connected to the headrail 10, while an end of the other warp 16*a* remains as being connected to the corresponding ladder drum 20. Such design could also achieve the same operation, i.e., pulling up one of the warps 16*a* and lowering down the other one at the same time through the rotation of the corresponding ladder drum 20. Alternatively, an end of the warps 16*a* located in the headrail 10 could be directly connected to a structure used for rotating the corresponding ladder drum 20. For example, said end of each of the warps 16*a* could be connected to the shaft 22 which passes through the corresponding ladder drum 20.

Figure 8:
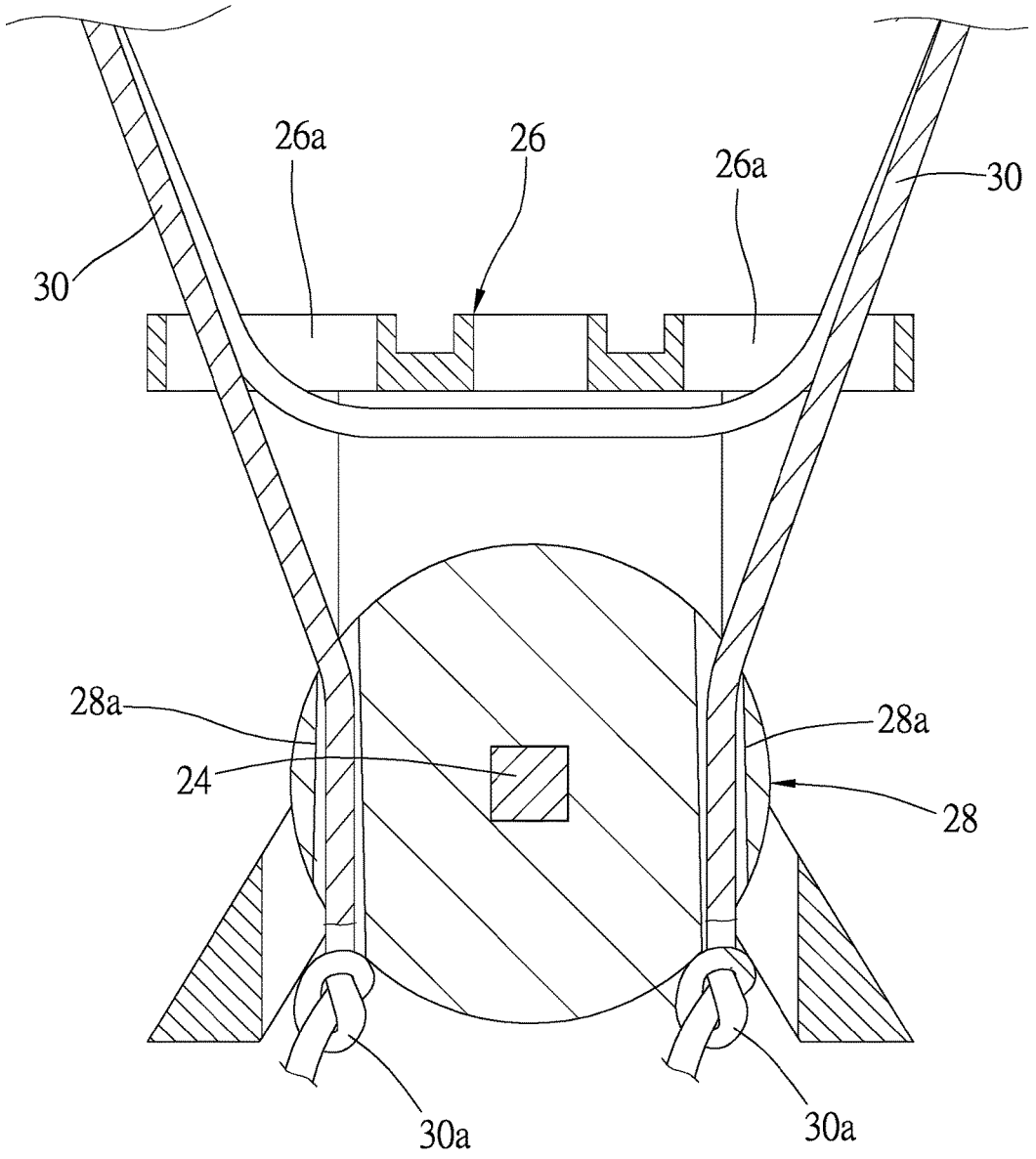
FIG. 8 is similar to FIG. 6, showing the window blind of a second embodiment of the present invention, which has a knot formed at the end of each warp.

In the aforementioned first embodiment, the other end of each of the warps 16*a* passes through the bottom rail 12 to be connected thereto, so that the direction-changing members 28 and the ladder drums 20 could rotate synchronously due to the pulling of the warps 16*a*. However, in a window blind of a second embodiment of the present invention, which is illustrated in FIG. 8, warps 30 of one ladder tape are two independent cords, though the window blind of the second embodiment also includes the transmission shaft 24, the positioning bases 26, and the direction-changing members 28 as described in the first embodiment. The warps 30 are knotted to form a knot 30*a*, which abuts against a surface of the corresponding direction-changing member 28, after passing through the perforations 26*a* of the corresponding positioning base 26 and the passages 28*a* of the corresponding direction-changing member 28. Similarly, when the ladder drums 20 are rotated to pull up one of the warps 16*a* and to lower down the other one of the warps 16 at the same time, each of the warps 30 would be maintained in a tightened condition by pulling and rotating the direction-changing members 28, which ensures each of the slats 14 could be tilted smoothly and closed tightly.

It has to be explained that, the transmission shaft 24 is provided in the aforementioned embodiments to rotate the direction-changing members 28 synchronously. However, since each of the direction-changing members 28 already could be rotated by one of the ladder tapes 16 in practice, it is not always necessary to have the transmission shaft 24 in the window blind 100. In other words, the transmission shaft 24 is optional, and could be omitted in other embodiments.

Figure 9:
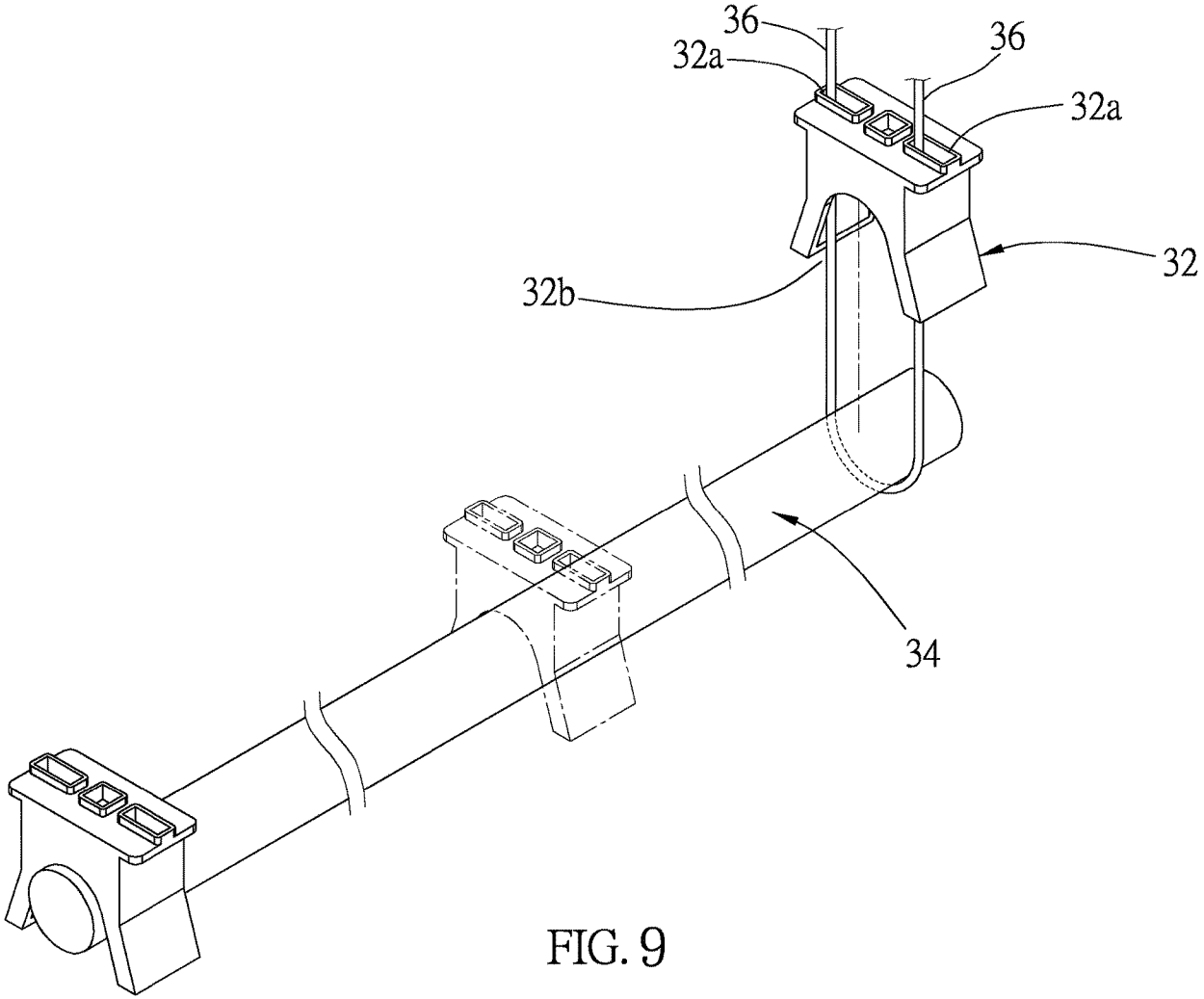
FIG. 9 is similar to FIG. 5, showing the relation between the warp of the ladder tape, the positioning base, and the direction-changing member of the window blind of a third embodiment of the present invention.

A window blind of a third embodiment of the present invention is illustrated in FIG. 9, which also includes a plurality of positioning bases 32 in the bottom rail 12, and each positioning base 32 also has two perforations 32*a* and a recess 32*b* with an opening facing downward, as described in the aforementioned embodiments. However, the difference between the aforementioned embodiments and the third embodiment is that, a direction-changing member 34 thereof is a round rod, which is provided in the recess 32*b* of each of the positioning bases 32. As disclosed in the above embodiments, two warps 36 of each ladder tape are connected to the corresponding ladder drum (not shown) with an end thereof, and are connected to each other with another end thereof after passing through the bottom rail and the perforations 32*a* of the corresponding positioning base 32, and bypassing the corresponding direction-changing member 34. As a result, the part of the warps 36 bypassing the corresponding direction-changing member 34 would be U-shaped.

As mentioned in the first embodiment, said warps 36 could belong to one single cord arranged in an U shape (so they are, by definition, connected inherently), or could be two independent cords which are either knotted together or connected to each other through a connector. Though one of the warps 36 goes up and the other one of the warps 36 goes down when the corresponding ladder drum is rotated, both the warps 36 could be still tightened, for the warp 36 bypass the corresponding direction-changing member 34 instead of being fixed thereto. Whereby, the slats could be tightly closed. In addition, such arrangement of the warps 36 (i.e., bypassing the corresponding direction-changing member 34) is not a limitation of the present invention. If the friction between the components could be reduced in some ways, the warps 36 could be directly connected to each other after passing through the bottom rail. Since the warps 36 are not fixed to the bottom rail either, they could be maintained in a tightened condition as well.

It must be pointed out that the embodiments described above are only some preferred embodiments of the present invention. All equivalent structures which employ the concepts disclosed in this specification and the appended claims should fall within the scope of the present invention.

What is claimed is:

1. A window blind comprising a headrail, a bottom rail, a plurality of slats, and a ladder tape, which comprises two warps provided from the headrail toward the bottom rail, and a plurality of horizontal strings connected to the warps, wherein each of the horizontal strings supports one of the slats, so that the slats are horizontally suspended between the headrail and the bottom rail; characterized in that:

an end of each of the warps of the ladder tape is connected to the headrail, and another end thereof passes through the bottom rail; the another end of each of the warps is adapted to be operated to move in the bottom rail.

2. The window blind of claim 1, further comprising at least one direction-changing member provided in the bottom rail, wherein each of the at least one direction-changing member has at least one passage, which is adapted to be passed through by at least one of the warps passing through the bottom rail.

3. The window blind of claim 2, wherein the warps of the ladder tape are respectively located on two sides in a short axial direction of the slats; a part of each of the warps passing through the bottom rail bypasses a surface of one of the at least one direction-changing member in an opposite direction to be connected together, forming an U shape.

4. The window blind of claim 3, further comprising at least one positioning base provided in the bottom rail, wherein each of the at least one positioning base has a recess; each of the at least one direction-changing member is rotatably provided in the recess of one of the at least one positioning base.

5. The window blind of claim 3, further comprising a transmission shaft provided in the bottom rail, and at least one further ladder tape, wherein a number of the at least one direction-changing member equals a number of the ladder tape and the at least one further ladder tape; the transmission shaft goes through the direction-changing members in an axial direction thereof, and rotates along with the direction-changing members in the same direction synchronously.

6. The window blind of claim 1, further comprising at least one direction-changing member provided in the bottom rail, wherein the warps of the ladder tape are respectively located on two sides in a short axial direction of the slats; a part of each of the warps passing through the bottom rail bypasses a surface of one of the at least one direction-changing member in an opposite direction to be connected together, forming an U shape.

7. The window blind of claim 6, further comprising at least one positioning base provided in the bottom rail, wherein the at least one positioning base has a recess, and the at least one direction-changing member is a round rod provided in the recess.

8. The window blind of claim 2, wherein each of at least one of the warps of the ladder tape passes through one of the at least one passage of one of the at least one direction-changing member, and respectively forms a knot abutting against a surface of said direction-changing member.

* * * * *